US009638021B2

(12) United States Patent
Varkey et al.

(10) Patent No.: US 9,638,021 B2
(45) Date of Patent: May 2, 2017

(54) PUMP DEPLOYMENT VIA CABLE

(71) Applicant: Schlumberger Technology Corporation, Sugar Land, TX (US)

(72) Inventors: Joseph Varkey, Sugar Land, TX (US); Sheng Chang, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 642 days.

(21) Appl. No.: 14/093,516

(22) Filed: Dec. 2, 2013

(65) Prior Publication Data

US 2014/0158380 A1 Jun. 12, 2014

Related U.S. Application Data

(60) Provisional application No. 61/735,156, filed on Dec. 10, 2012.

(51) Int. Cl.

| | |
|---|---|
| ***E21B 44/00*** | (2006.01) |
| ***E21B 34/06*** | (2006.01) |
| ***E21B 33/08*** | (2006.01) |
| ***E21B 43/12*** | (2006.01) |
| ***E21B 47/12*** | (2012.01) |

(Continued)

(52) U.S. Cl.

CPC ..... *E21B 44/005* (2013.01); *E21B 17/206* (2013.01); *E21B 19/084* (2013.01); *E21B 33/08* (2013.01); *E21B 34/06* (2013.01); *E21B 43/128* (2013.01); *E21B 47/124* (2013.01)

(58) Field of Classification Search

CPC .... E21B 44/005; E21B 19/084; E21B 43/128; E21B 47/24; E21B 33/08; E21B 34/06

See application file for complete search history.

(56) References Cited

U.S. PATENT DOCUMENTS

| | | | | |
|---|---|---|---|---|
| 2,883,833 | A * | 4/1959 | Miles | B65G 5/00 166/80.1 |
| 3,556,209 | A | 1/1971 | Reistle, III et al. | |
| 2006/0060357 | A1 | 3/2006 | Kelly et al. | |

(Continued)

FOREIGN PATENT DOCUMENTS

| | | |
|---|---|---|
| EP | 1061231 | 12/2000 |
| WO | 2011150213 A2 | 12/2011 |

OTHER PUBLICATIONS

Search report for the equivalent GB patent application No. 1321556.1 issued on Jun. 12, 2014.

*Primary Examiner* — Shane Bomar

(74) *Attorney, Agent, or Firm* — Michael Stonebrook

(57) ABSTRACT

A method can include providing a pump connected to a power cable with a smooth surface; providing a stuffing box with a valve configured to form a seal with the smooth surface of the power cable in a closed state and to form a passage for the pump as connected to the power cable in an open state; providing a lubricator; providing a blow-out protector with a valve configured to form a seal with the smooth surface of the power cable in a closed state and to form a passage for the pump as connected to the power cable in an open state; and controlling the states of the valves while lowering the pump via the power cable through the stuffing box, the lubricator, and the blow-out protector to position the pump into a bore of a well. Various other apparatuses, systems, methods, etc., are also disclosed.

9 Claims, 10 Drawing Sheets

(51) Int. Cl.
*E21B 17/20* (2006.01)
*E21B 19/084* (2006.01)

(56) References Cited

U.S. PATENT DOCUMENTS

| | | | | |
|---|---|---|---|---|
| 2011/0240312 | A1 | 10/2011 | Varkey et al. | |
| 2011/0297397 | A1 | 12/2011 | Morrison et al. | |
| 2012/0292051 | A1* | 11/2012 | Wetzel | E21B 43/128 166/385 |
| 2013/0098632 | A1* | 4/2013 | Wetzel | E21B 43/128 166/373 |
| 2013/0233587 | A1 | 9/2013 | Varkey et al. | |

* cited by examiner

PUMP DEPLOYMENT VIA CABLE

RELATED APPLICATION

This application claims the benefit of U.S. Provisional Patent Application having Ser. No. 61/735,156, filed 10 Dec. 2012, which is incorporated by reference herein.

BACKGROUND

In the oil and gas industry, natural gas pressure may propel crude oil in a well. In wells with diminished gas pressure or, for example, in wells with heavy oil, pressure may be insufficient to propel the oil. In such instances, a pump may be implemented, for example, which may be a downhole pump.

Different types of pumping systems may be disposed downhole in a well to pump desired fluids (e.g., to the surface). For example, sucker rod pumps have been used to pump oil to the surface in low pressure wells. Other types of pumps include electrical submersible pumps (ESPs), such as a Russian Electrical Dynamo of Arutunoff (REDA) pump.

As an example, a pump may be attached to the bottom of a production string for pumping fluid up from a well by generating a pressure boost sufficient to lift the fluid. Such a pump may be deployed in a variety of environments, optionally including deep water subsea developments. As an example, power may be provided to a pump by a cable, which may be intended for long-term deployment in a well. Various technologies, techniques, etc., described herein, may facilitate deployment, placement, operation, retrieval, etc. of electrically powered equipment.

SUMMARY

A method can include providing a pump connected to a power cable with a smooth surface; providing a stuffing box with a valve configured to form a seal with the smooth surface of the power cable in a closed state and to form a passage for the pump as connected to the power cable in an open state; providing a lubricator; providing a blow-out protector with a valve configured to form a seal with the smooth surface of the power cable in a closed state and to form a passage for the pump as connected to the power cable in an open state; and controlling the states of the valves while lowering the pump via the power cable through the stuffing box, the lubricator, and the blow-out protector to position the pump into a bore of a well. A controller can include a processor; memory accessible by the processor; and control logic implemented by the processor to control a deployment process for deploying a pump connected to a cable into a bore by controlling states of valves associated with the bore. A completion can include a pump seated in a pump seat within a bore; valve units positioned in the bore above the pump; and a Christmas tree positioned at an end of the bore above the valve units, where each of the valve units forms a respective seal with a cable connected to the pump. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Artificial lift equipment such as electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in environments that may call for, as an example, pump rates in excess of 4,000 barrels per day and lift of 12,000 feet or more.

To improve ESP operations, an ESP may include one or more sensors (e.g., gauges) that measure any of a variety of phenomena (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current-leakage. An ESP monitoring system may include a supervisory control and data acquisition system (SCADA). Commercially available surveillance systems include the espWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop or control ESP speed via an ESP controller. As an example, sensing and/or monitoring equipment associated with an ESP may optionally be employed during a deployment process that includes deploying the ESP via a power cable. For example, a controller may optionally control deployment based at least in part on sensed information (e.g., acquired during deployment).

As to power cables, as an example, a round ESP cable construction (e.g., for operation up to 5 kV or optionally more) can include one or more copper conductors. As an example, a cable can includes of a number of solid-strand, polymer-bonded metallic conductors configured in a smooth-surface, bonded-polymer-jacketed cable. Such a cable may be referred to as a "slick" power cable, for example, compared to a power cable with a metallic armor, which may be corrugated or rough. As an example, a cable may include ample conductor capacity, strength members to allow it to carry the weight of a tool string (e.g., an ESP tool string) and the cable itself and may include a readily sealable smooth circular profile.

Figure 1:
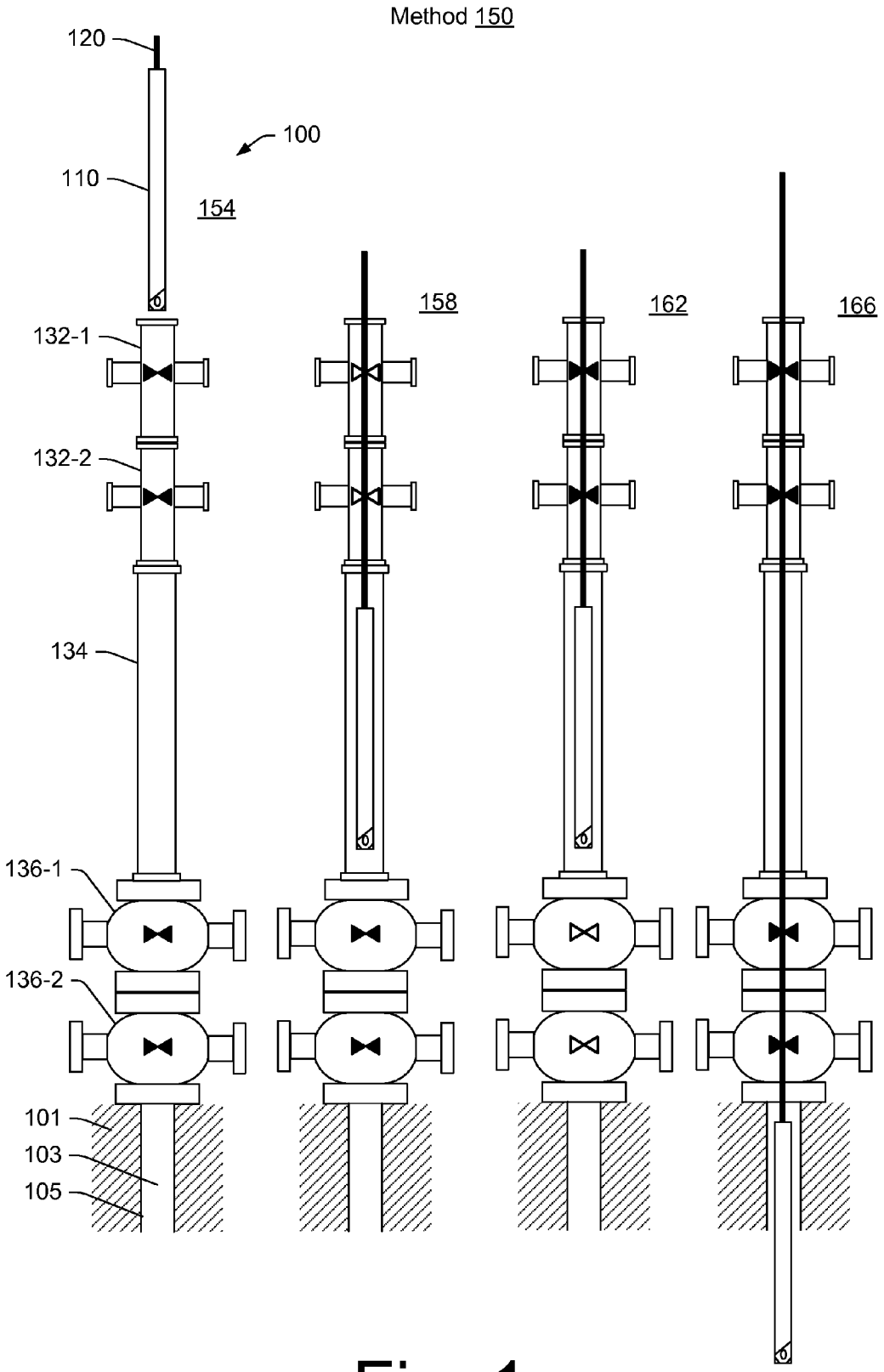
FIG. 1 illustrates an example of a system and an example of a method.

FIG. 1 shows an example of a system 100 and an example of a method 150 for lowering an ESP (e.g., as a tool string) into a live well using a smooth-jacketed ESP cable (e.g., a slick power cable). Such a method can avoid having to "kill" a well, for example, with drilling mud and then having to remove the mud once the ESP is in place. Accordingly, the method 150 of FIG. 1 may involve less labor and equipment than methods that involve killing a well with mud. As shown in FIG. 1, the method 150 can be implemented using the system 100, which includes multiple pressure barriers.

In the example of FIG. 1, the system 100 includes, with respect to a formation 101, a pump 110, a cable 120, a stuffing box 132-1, a stuffing box 132-2, a lubricator 134, a blow-out protector 136-1, a blow-out protector 136-2. As shown, the formation 101 includes a bore 103 (e.g., a wellbore) and optionally a casing 105.

In the example of FIG. 1, the method 150 is shown with respect to four states 154, 158, 162 and 166 of the system 100. In the state 154, valves of the stuffing boxes 132-1 and 132-2 are closed as are valves of the BOPS 136-1 and 136-2. The pump 110 and the cable 120 are provided and positioned for insertion into the upper stuffing box 132-1. In the state 158, the valves of the stuffing boxes 132-1 and 132-2 have been opened and the pump 110 and a portion of the cable 120 inserted therethrough to lower the pump 110 into the lubricator 134. In the state 162, the valves of the stuffing boxes 132-1 and 132-2 are closed about the cable 120 to seal the cable 120 and the valves of the BOPS 136-1 and 136-2 are opened. In the state 166, the pump 110 and a portion of the cable 120 have been inserted into the bore 103 and the valves of the BOPS 136-1 and 136-2 have been closed. In such a manner, the pump 110 has been installed into a live well, for example, optionally without having to deposit mud or other material into the bore 103. While one pump is shown, multiple pumps may be provided via the single cable. Pumps may be selected from various types of pumps (e.g., to be powered by power delivered via the cable).

Figure 2:
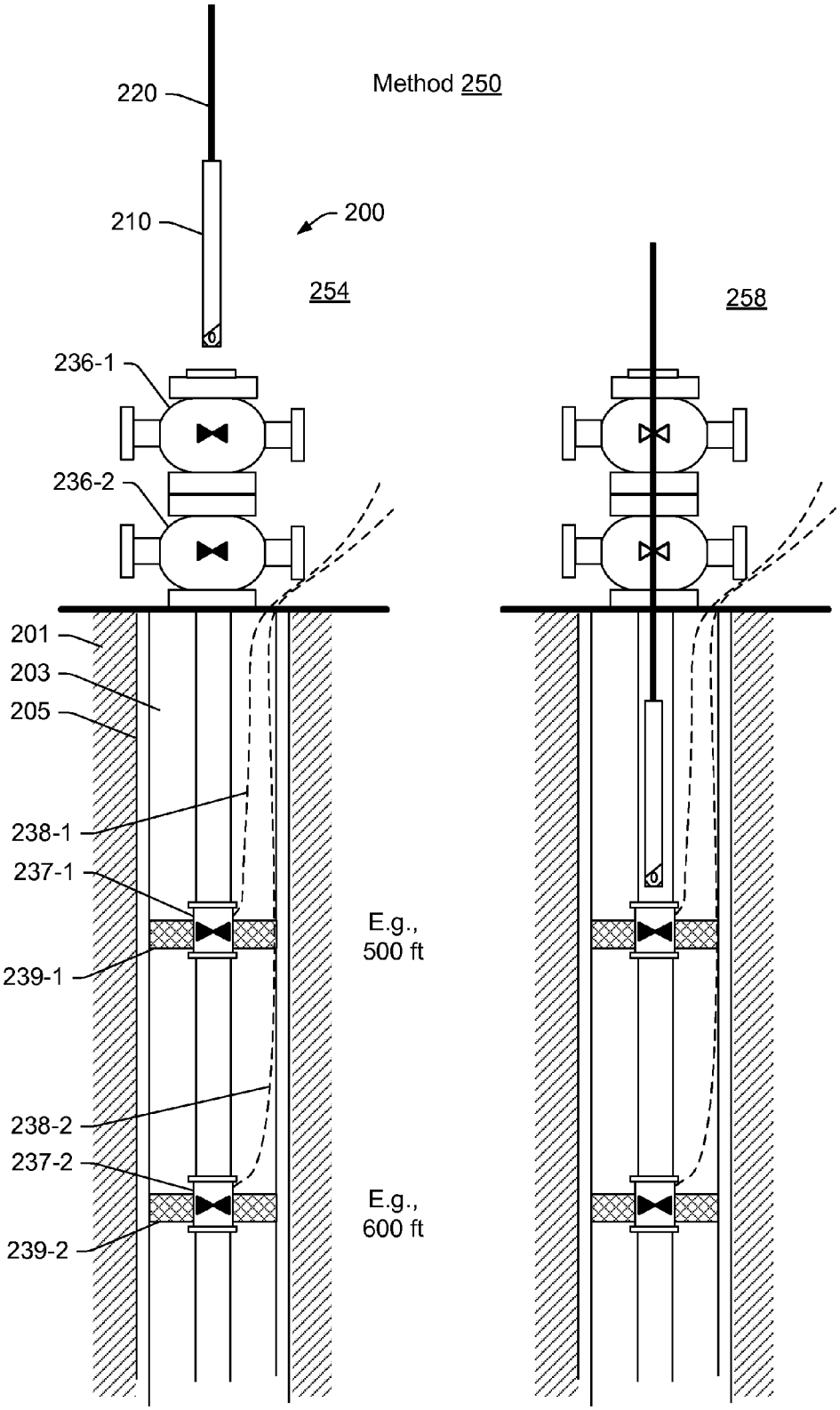
FIGS. 2 and 3 illustrate an example of a system and an example of a method.
Figure 3:
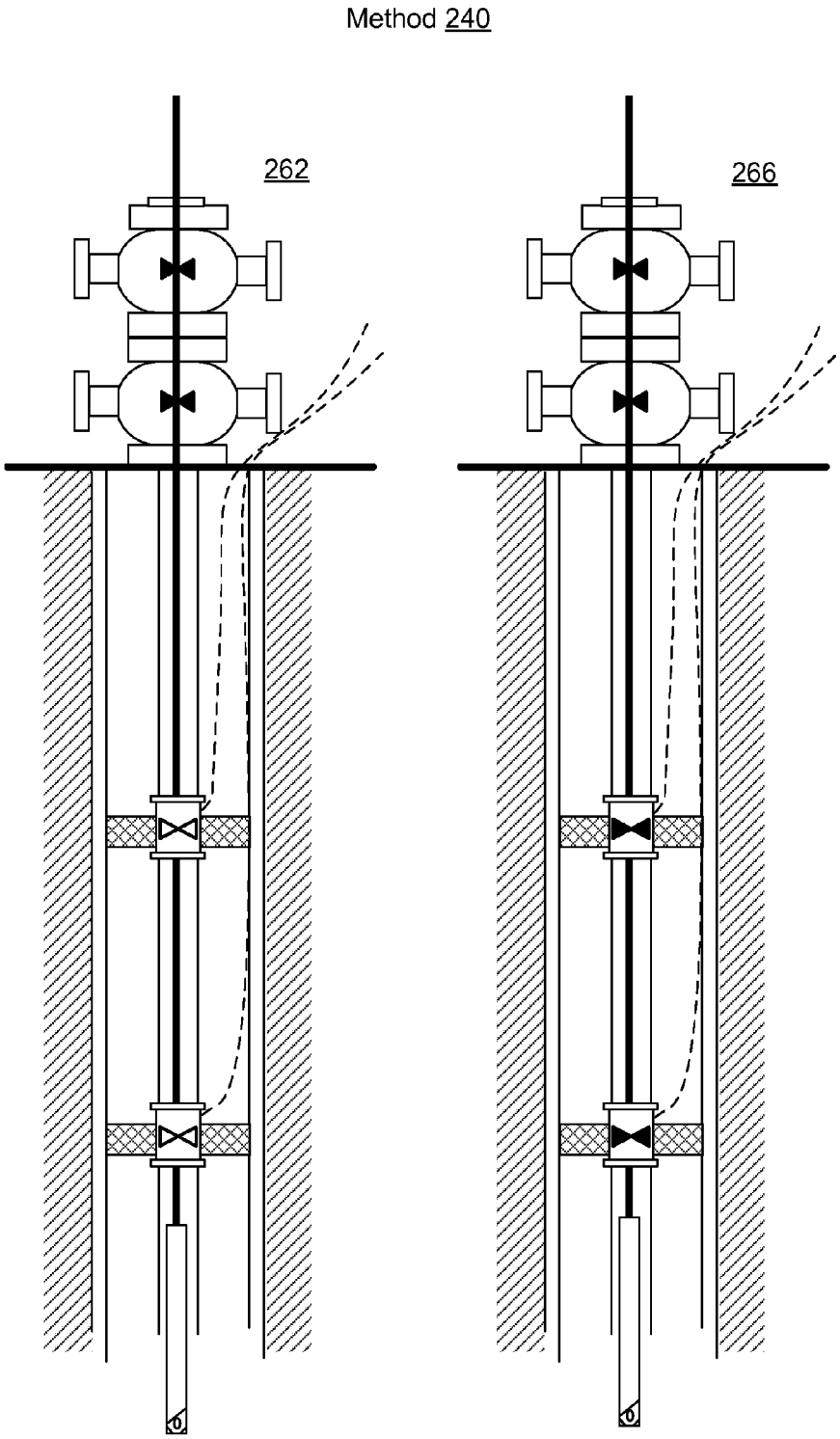

FIGS. 2 and 3 show an example of a method 250 with respect to a system 200 as being in various states 254, 258, 262 and 266. The system 200 includes, with respect to a formation 201, a pump 210, a cable 220, a stuffing box a blow-out protector 236-1, a blow-out protector 236-2, a downhole valve unit 237-1, a control line 238-1, a packer 239-1, a downhole valve unit 237-2, a control line 238-2 and a packer 239-2. As shown, the formation 201 includes a bore 203 and optionally a casing 205.

In the state 254, the pump 210 is provided connected to the cable 220 where valves of the BOPS 236-1 and 236-2 are closed. In the state 258, the valves of the BOPS 236-1 and 236-2 are open and the pump 210 and a portion of the cable 220 passed therethrough into an upper space defined between the valve unit 237-1 and the BOP 236-2. In the state 262, the valves of the valve units 237-1 and 237-2 have been opened and the pump 210 and a portion of the cable 220 have been passed therethrough where the pump 210 is below the lower packer 239-2. In the state 266, the valves of the valve units 237-1 and 237-2 have been closed to seal the cable 220 while the pump 210 is disposed in the bore 203.

Figure 4:
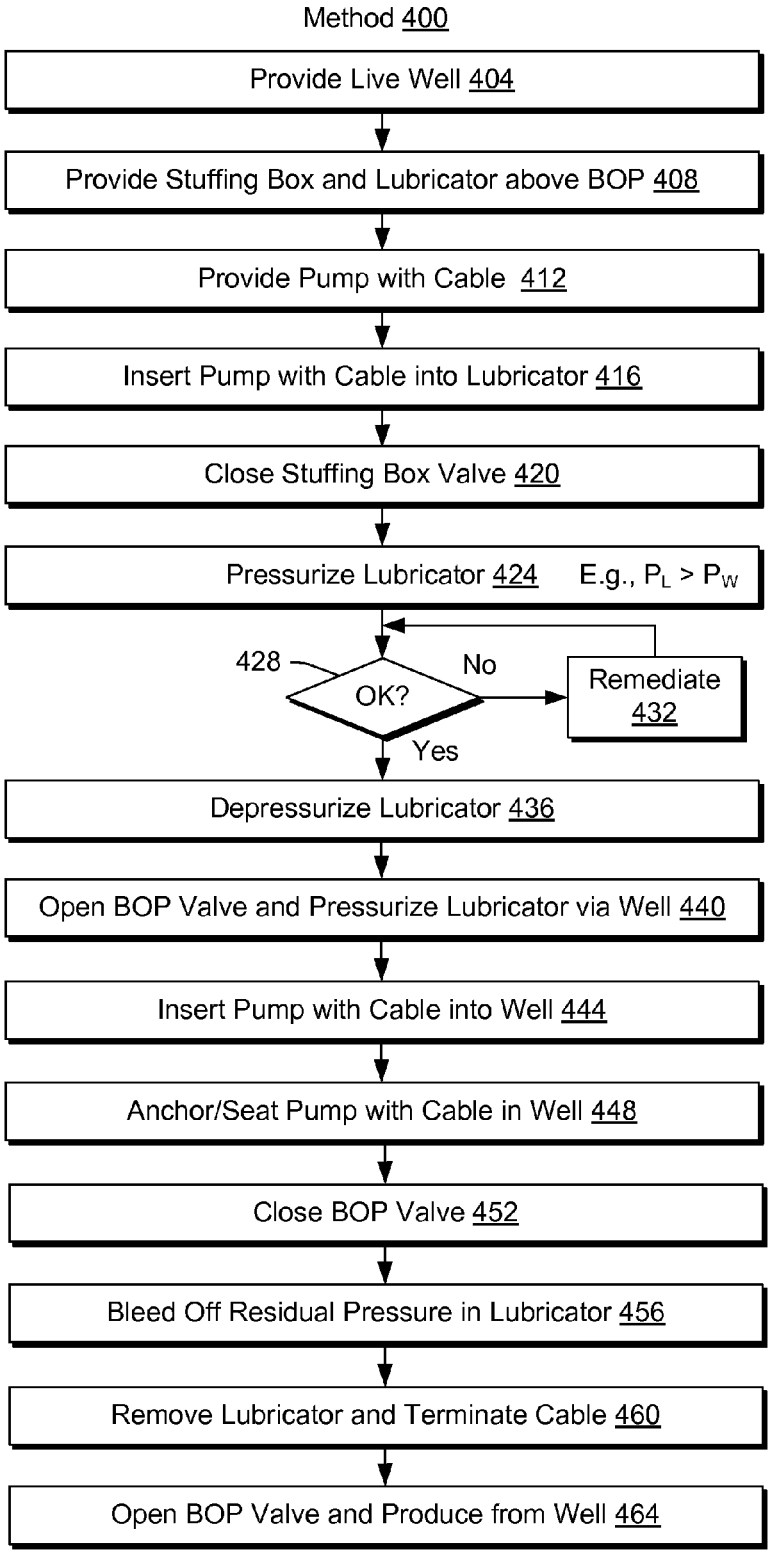
FIG. 4 illustrates an example of a method.

FIG. 4 shows an example of a method 400 that includes a provision block 404 for providing a live well, a provision block 408 for providing a stuffing box and a lubricator above a provided BOP, a provision block 412 for providing a pump with a cable (e.g., a smooth or slick power cable), an insertion block 416 for inserting the pump with the cable into the lubricator, a close block 420 for closing a valve of the stuffing box, a pressurize block 424 for pressurizing the lubricator (e.g., to a pressure greater than that of the live well), a decision block 428 for deciding whether the lubricator is leaking (e.g., whether it can withstand the pressure), a remediation block 432 for remediating one or more issues if leakage occurs, a depressurization block 436 for depressurizing the lubricator, an open block 440 for opening a BOP valve and pressurizing the lubricator via well pressure, an insertion block 444 for inserting the pump with the cable into the well, an anchor or seating block 448 for anchoring or seating the pump with the cable in the well, a close block 452 for closing the valve of the BOP, a bleed block 456 for bleeding off any residual pressure in the lubricator, a removal block 460 for removing the lubricator (e.g., from the BOP) and optionally terminating the cable (e.g., cutting the cable, etc.) and an open block 464 for opening the BOP valve and optionally producing fluid from the well (e.g., via operation of the pump via power provided by the cable).

As an example, a lubricator may be provided above one or more BOPs, for example, the one or more BOPs may include valves that are closed to ease connection of the lubricator to one of the BOPs (e.g., or an intermediate conduit connected to one of the BOPs). As an example, a toolstring along with the cable may be inserted into a lubricator, for example, where the lubricator has a stuffing box above it with a rubber/rubberized pack-off, nose guide, etc., to bias the cable and seal the cable (e.g., against leakage of fluid adjacent the surface of the cable).

As an example, given a toolstring and cable inside a lubricator, valves in one or more stuffing boxes may be closed and the lubricator pressurized. During or after pressurization, a test may be performed to determine whether the lubricator is leaking or can otherwise withstand a particular amount of pressure. In such an example, if there is no leakage (e.g., the stuffing box/lubricator is able to hold the pressure (e.g., via well)), then the lubricator may be depressurized (e.g., if pressurized to a pressure higher than that of the well), and the valve of a BOP may be opened to allow well pressure to pressurize the lubricator (e.g., as sealed at one end by one or more stuffing boxes). In such an example, once the pressure has substantially equalized (e.g., equilibrated) without any leakage (e.g., per one or more measurements, observations, etc.), a pump may be lowered into the well to, for example, a seat or anchor point of the well.

As an example, once a pump has been anchored or seated, for example, as evidenced by a reduction in weight on the cable attached to the pump, then a BOP valve or BOP valves may be closed. In such a manner, any residual pressure in a lubricator may be relieved (e.g., bled off) and the lubricator may be removed. The cable may be terminated or otherwise arranged, configured, etc., as appropriate for performing a task or tasks related to the downhole pump.

As an example, a "Christmas tree" may be configured with respect to one or more BOPs, which may be part of the Christmas tree. As an alternative, one or more BOPs may be replaced (see, e.g., the examples of FIGS. 2 and 3 where one or more downhole valve units may allow for replacement of a BOP, etc.). As an example, a Christmas tree may be an assembly of equipment such as valves, spools, pressure gauges and chokes fitted to a wellhead of a completed well to control production. Christmas trees may be available in a wide range of sizes and configurations, such as low- or high-pressure capacity and single- or multiple-completion capacity.

As an example, a system can include a pump terminated to a smooth-jacketed pump (e.g., ESP, etc.) cable isolated in production tubing between a top blow-out preventer (BOP) and one or more stuffing boxes. Once the equipment is in place, the one or more stuffing boxes can act as one or more pressure barriers as one or more BOPs are opened and the pump is lowered into a well. Once lowered into place, the one or more BOPs may be closed onto the cable to provide pressure barriers.

As an example, a system can include two lengths of production string fitted with valves (e.g., hydraulically operated, electrically operated, etc.) placed in a bore beneath one or more BOPs. Such valves can act as pressure barriers as a cable-mounted pump (e.g., ESP, etc.) is lowered through the one or more BOPs. Once the pump is lowered into place, the one or more BOPs can seal against the cable to act as one or more pressure barriers.

While a well may lack sufficient sustained pressure to efficiently produce oil at the surface, it may still have residual pressure and possibly unexpected surges in pressure (e.g., well kicks), which may result in a decision to temporarily "kill" the well while a pump (e.g., ESP, etc.) is deployed into the well or deeper into the well. A kill may be accomplished by pumping mud into the well to effectively seal off any well pressure. In a killed well, a pump may be deployed on the end of a string of production tubing assembled piece by piece at the well surface, which is then lowered into the well. In such an example, a power cable (e.g., designed solely to carry power to the pump in the well), may attached to the outside of the production tubing at regular intervals. Once the pump has been deployed, the mud must be pumped out of the well before the well can begin producing again.

As an example, a method can provide for deploying a cable-mounted ESP into live well using above ground stuffing boxes as pressure barriers. As an example, such a method may be implemented using a system that includes two stuffing boxes attached to a length of production tubing to provide two pressure barriers to allow the cable-mounted ESP to be deployed into a live well. In such an example, to enable the pump to descend effectively into the well, the weight of the tool string containing the pump may be approximately 500 pounds to approximately 1,000 pounds. As an example, such a method may be implemented using various equipment of the system 100 of FIG. 1. As shown in FIG. 1, open valves are represented by open triangles and closed valves are represented by closed triangles.

As an example, a method can include: two stuffing boxes attached to a length of production string are mounted above the BOPs; the stuffing box valves are open and a ESP-cable-mounted ESP is lowered into the length of production string; the valves on the stuffing boxes are closed over the ESP cable and the BOPs are opened; and once the ESP has been lowered into position in the well, the BOPs are closed onto the ESP cable.

As an example, a method may be implemented using various pieces of equipment as shown in the system 200 of FIGS. 2 and 3. Such a method may use two valves mounted on lengths of production tubing below one or more BOPs to provide one or more pressure barriers to allow a cable-mounted ESP to be deployed into a live well. As an example, to facilitate descent of the pump effectively into the well, the weight of the tool string including the pump may be approximately 500 pounds to approximately 1,000 pounds (e.g., noting that the cable may be appropriately selected to accommodate such a weight, and the weight of the length of cable itself).

As an example, a method can include: two valves attached to lengths of production string are mounted below the BOPs where the valves may be actuatable (e.g., electrically, hydraulically, etc.) via cables or tubing running to the surface of the well (e.g., optionally configured to carry fluid); packers are placed around the valves to seal against the well casing to provide additional pressure seals; at the beginning of the process, all valves are closed; the BOP valves are opened and the ESP-cable-mounted ESP is lowered into the length of production string immediately below the BOPs; the valves on the lengths of production string remain closed; the BOPs are closed over the ESP cable and the underground valves on the lengths of production string are opened; once the ESP has been lowered into position in the well, the valves on the lengths of production string are closed onto the ESP cable.

Figure 5:
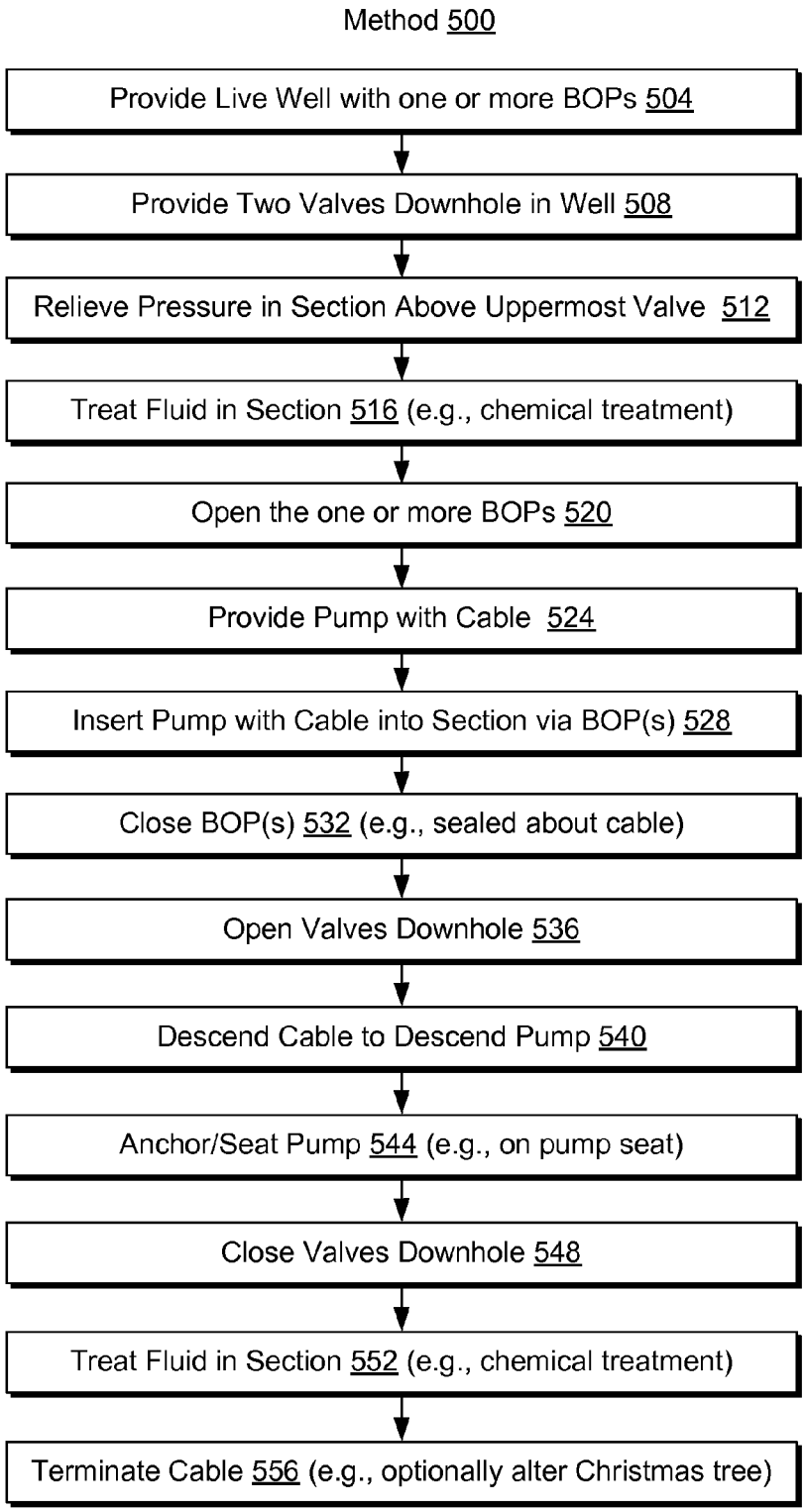
FIG. 5 illustrates an example of a method.

FIG. 5 shows an example of a method 500 that includes a provision block 504 for providing a live well with one or more BOPs, a provision block 508 for providing two valves downhole in the well, a relief block 512 for relieving pressure in a section of the well above the uppermost downhole valve, an optional treatment block 516 for treating fluid in the section (e.g., chemical treatment of $H_2S$, $CO_2$, etc.), an open block 520 for opening the one or more BOPs (e.g., opening valves of the one or more BOPs, where the valves provide for passage of a pump), a provision block 524 for providing a pump with a cable (e.g., a smooth surfaced power cable of an integrity sufficient to carry the weight of the pump and the cable itself), an insertion block 528 for inserting the pump with the cable into the section via the one or more BOPs, a close block 532 for closing the one or more BOPs (e.g., to seal about the cable while the cable may still translate within the one or more BOPs), an open block 536 for opening the valves downhole, a descend block 540 for descending the cable to descend the pump, an anchor or seat block 544 for anchoring or seating the pump (e.g., on a pump seat), a close block 548 for closing the valves downhole where the valves seal about the cable, an optional treatment block 552 for treating fluid in one or more sections above the lowermost valve and one or more other pieces of equipment, and a termination block 556 for terminating the cable (e.g., to provide for connection to power, communication equipment, etc.); noting that a Christmas tree may be constructed by adding jewelry (e.g., pieces of equipment), optionally removing one or more of the BOPs, replacing one or more of the BOPs with one or more other pieces of equipment, etc.

As an example, a so-called shallow completion may be used. In the example of FIGS. 2 and 3, the downhole valves may be disposed at a depth of about 500 feet and about 600 feet. Such valves may include control lines for operating the valves (e.g., selecting a valve state). As an example, the control lines may include one or more passages for delivery of fluid. For example, such passages may provide for pressure relief (e.g., pressure in a section to be relieved via passage of fluid from the section into the control line), delivery of chemical (e.g., to treat fluid such as $H_2S$, $CO_2$, etc.), or one or more other functions. As an example, valves may be operable in unison or independently.

As an example, a valve may provide for passage of a pump connected to a cable and close upon the cable to provide for sealing about the outer surface of the cable while still allowing for sliding of the cable to position the pump (e.g., raise or lower the pump). As an example, a valve may have a "closed" state that allows for sealing about a cable with sliding of the cable and another "closed" state that applies greater force or otherwise increases friction force between a valve surface and the outer surface of the cable, for example, for use when a pump has been seated or anchored. As an example, a valve can include a closed state for closing off flow of fluid, pressure, etc., without a cable passing therethrough.

As to open states, a valve may have an open state that allows for passage of a pump and one or more other open states that provide for passage of fluid, however, with a cross-sectional area or other passage configuration that does not permit passage of a pump. As an example, an open state of a valve may provide for passage of fluid while a cable or a pump is disposed in the valve. Such passage of fluid may be via a region adjacent to the cable or the pump, via another region, or a combination of both. For example, a valve may include a central opening for receipt and passage of a pump and cable. Such a central region may be surrounded by one or more controllable passages for flow of fluid. As an example, once a cable is within the central region, clamping of the cable may occur (e.g., to form a seal about the cable) where the clamping may allow for sliding of the cable. As to flow of fluid, the one or more controllable passages may be controlled to allow for passage of fluid. As an example, a valve may include an annular surface formed by one or more components that can apply a force to an outer surface of a cable for a pump. Such an annular surface can seal the cable and may be selected from a material that is compatible with the material forming the outer surface of the cable. For example, such materials may be selected to allow for sliding while sealing. As an example, a valve may include one or more rubber components to seal and to provide for sliding while sealing of a cable.

Figure 6:
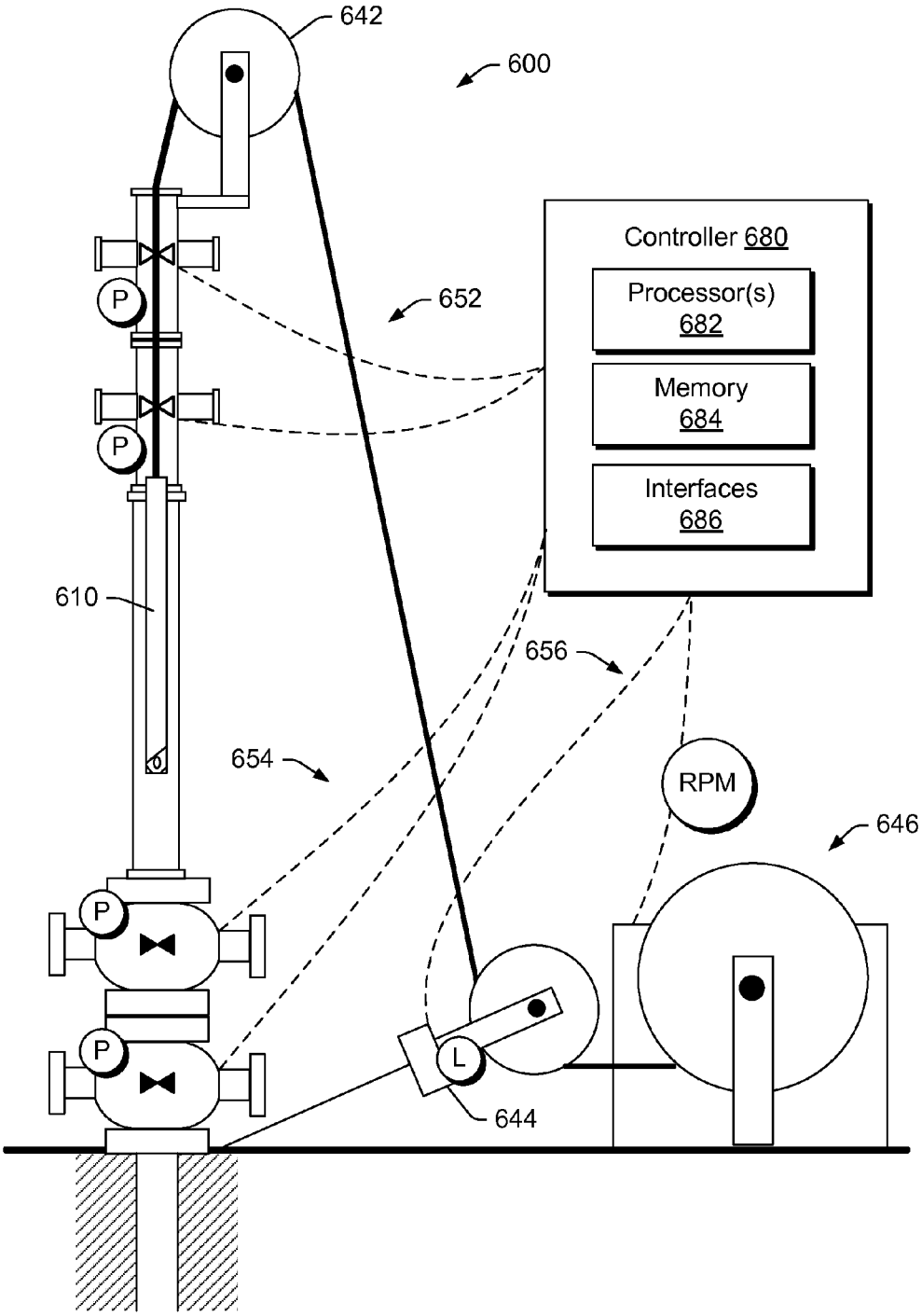
FIG. 6 illustrates an example of a system.

FIG. 6 shows an example of a system 600 that includes a pump 610, a cable 620, deployment equipment 642, 644 and 646, control lines 652, 654, and 656, a controller 680 and, for example, pieces of equipment as exhibited in FIG. 1. As shown, the piece of equipment 644 may include a load gauge and the piece of equipment 646 (e.g., including a reel or other carrier for cable) may provide for providing cable or retracting cable, for example, at one or more rates. In the example of FIG. 6, the controller 680 includes one or more processors 682, memory 684 (e.g., a memory device with memory), and one or more interfaces 686. As indicated, the control lines 652, 654 and 656 may communicate with the controller 680 for various purposes. For example, to control valves, to sense pressure via one or more pressure gauges (see, e.g., "P"), to sense load via one or more load gauges (see, e.g., "L"), to sense speed of deployment (see, e.g., RPM), etc.

As an example, upon seating or anchoring a pump, the controller 680 may sense load and then control the deployment equipment to stop deployment, take up any slack, etc. (e.g., via the equipment 646). As an example, where a cable includes a strain sensor (e.g., one or more optical fibers configured to sense strain or one or more other types of strain sensors), sensed strain information may optionally be used by a controller to control a process. For example, the controller 680 may include an input for receipt of strain information, which may optionally be used in conjunction with load information, for example, to control deployment of a pump via a power cable (e.g., by controlling a reel, controlling one or more valves, etc.).

Figure 7:
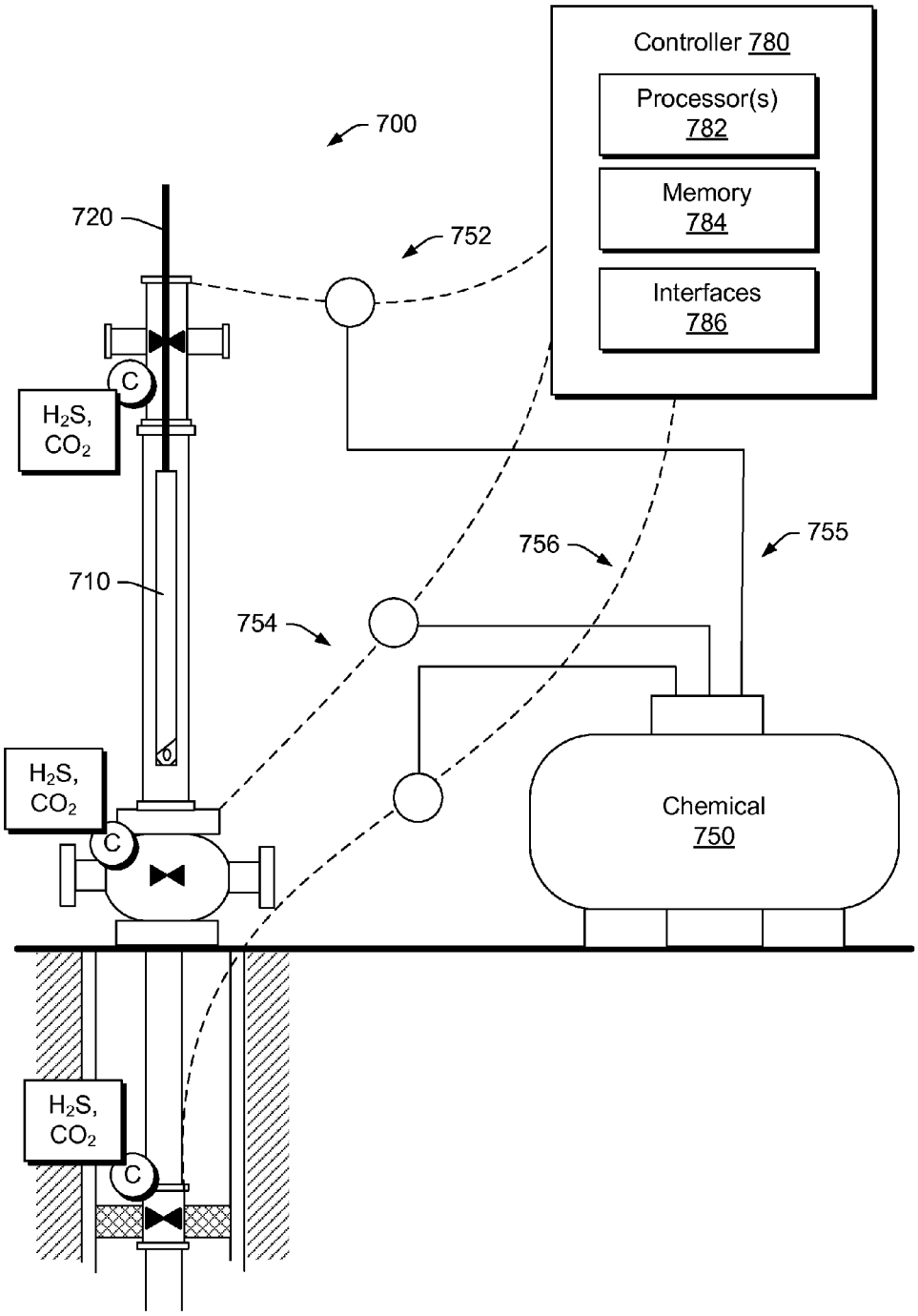
FIG. 7 illustrates an example of a system.

FIG. 7 shows an example of a system 700 that includes a pump 710, a cable 720, chemical handling equipment 750 and 755, control lines 752, 754, and 756, a controller 780 and, for example, pieces of equipment as exhibited in FIG. 1. As shown, the system 700 may optionally include chemical sensors, which may be located at the equipment or at the controller 780, for example, where one of the control lines can deliver a sample of fluid to the controller 780 for analysis. When chemical treatment is desired, one or more chemicals may be delivered via a chemical delivery system to one or more portions of the system 700, whether an above ground or below ground portion of the system 700. For example, each of the control lines 752, 754 and 756 may include one or more passage for delivery of chemical to a portion of the system 700.

In the example of FIG. 7, the controller 780 includes one or more processors 782, memory 784 (e.g., a memory device with memory), and one or more interfaces 786. The controller 780 may control one or more injectors for injecting chemical, optionally via one of the control lines 752, 754 or 756. The chemical handling equipment 750 may be a chemical tank to hold chemical under pressure or otherwise fitted with one or more pumps, etc., to cause chemical to flow responsive to command by the controller 780. As an example, a process may be coordinated by the controller 780 for lowering the pump 710 into the well where the process includes chemical injection.

As an example, the system 600 and the system 700 may be part of a single system that can be configured as desired for various purposes. As an example, the controller 680 and the controller 780 may be a single controller to perform various acts, for example, as to a system that may include one or more features of the system 100 of FIG. 1, the system 200 of FIG. 2, the system 600 of FIG. 6 or the system 700 of FIG. 7.

As an example, a pump may be fitted with one or more sensors (e.g., one or more gauges) and such gauges may be activated for sensing where a controller can use sensed information in controlling a process that includes lowering a pump via a cable into a well (e.g., a live well). For example, a pressure sensor fitted to a pump may be activated and capable of transmitting information via a power cable connected to the pump. As an example, a sensor may include a wireless transmission feature, for example, suitable for use in a shallow completion where wireless transmission to a surface unit (e.g., a controller, etc.) may be accomplished. As an example, a pump may include one or more sensors that may be powerable by a battery included with the pump or sensor circuitry. Such battery power may be sufficient for sensing and transmission of information wirelessly to a controller that acts to control at least a portion of a process. As an example, a charged battery may be provided to allow for sensing and communicating during a deployment of a pump via a cable into a section of a well (e.g., a live well).

As an example, the system 200 of FIG. 2 may include one or more sensors fitted to the pump 210 with a battery and wireless communication circuitry where the battery powers the one or more sensors and communicates sensed information wirelessly to a controller. As an example, one or more of the sensors may be passive sensors, for example, where the battery powers circuitry to read a state, a signal, etc., of a passive sensor. As an example, a controller may transmit a control signal wirelessly to circuitry fitted to the pump, for example, to cause sensing, transmission of one or more sensed signals, etc. In such a manner, a controller may manage deployment of a pump via a cable in a live well while providing for opening and closing valves, relieving pressure, chemical treatment, etc.

Figure 8:
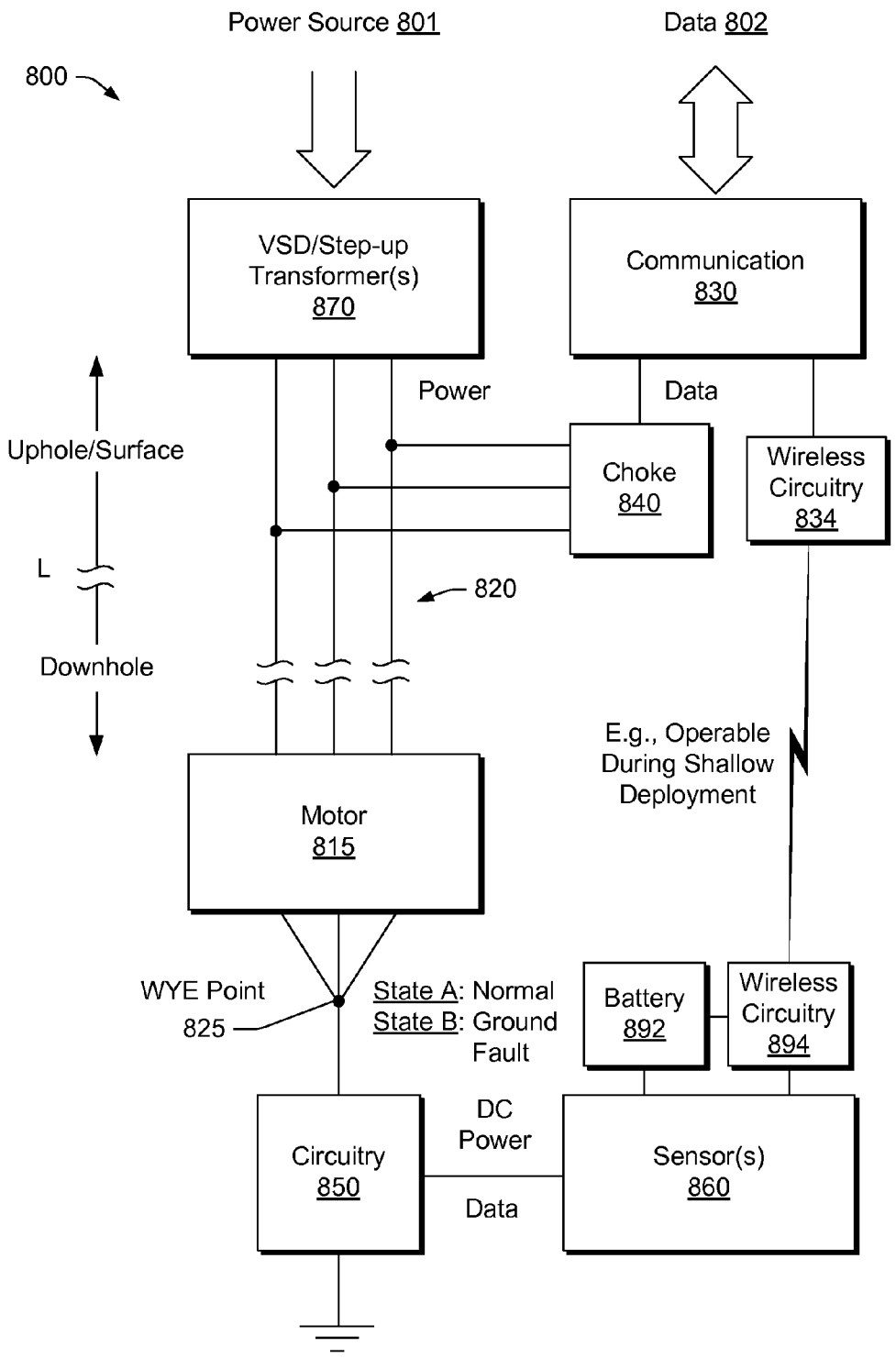
FIG. 8 illustrates an example of a system.

FIG. 8 shows a block diagram of an example of a system 800 that includes a power cable 820, optionally with MLEs. As shown, the system 800 includes a power source 801 as well as data 802. The power source 801 provides power to a VSD/step-up transformer block 870 while the data 802 may be provided to a communication block 830. The data 802 may include instructions, for example, to instruct circuitry of the circuitry block 850, one or more sensors of the sensor block 860, etc. The data 802 may be or include data communicated, for example, from the circuitry block 850, the sensor block 860, etc. In the example of FIG. 8, a choke block 840 can provide for transmission of data signals via the power cable 820.

As shown, the cable 820 connects to a motor block 815, which may be a motor (or motors) of an ESP and be controllable via the VSD/step-up transformer block 870. In the example of FIG. 8, the conductors of the cable 820 electrically connect at a wye point 825. The circuitry block 850 may derive power via the wye point 825 and may optionally transmit, receive or transmit and receive data via the wye point 825. As shown, the circuitry block 450 may be grounded.

The system 800 can operate in a normal state (State A) and in a ground fault state (State B). One or more ground faults may occur for any of a variety of reasons. For example, wear of the power cable 820 may cause a ground fault for one or more of its conductors.

The system 800 may include provisions to continue operation of a motor of the motor block 815 when a ground fault occurs. However, when a ground fault does occur, power at the wye point 825 may be altered. For example, where DC power is provided at the wye point 825 (e.g., injected via the choke block 840), when a ground fault occurs, current at the wye point 825 may be unbalanced and alternating. The circuitry block 850 may or may not be capable of deriving power from an unbalanced wye point and, further, may or may not be capable of data transmission via an unbalanced wye point.

The foregoing examples, referring to "normal" and "ground fault" states, demonstrate how ground faults can give rise to various issues. Power cables and MLEs that can resist damaging forces, whether mechanical, electrical or chemical, can help ensure proper operation of a motor, circuitry, sensors, etc. Noting that a faulty power cable (or MLE) can potentially damage a motor, circuitry, sensors, etc. Further, as mentioned, an ESP may be located several kilometers into a wellbore. In such an example, time and cost to replace a faulty ESP, power cable, MLE, etc., may be substantial.

As shown in the example of FIG. 8, wireless circuitry 834, a battery 892 and wireless circuitry 894 may be provided. Such circuitry may be operable during deployment of a pump via a cable. For example, such circuitry may be implemented in one or more of the states shown in FIG. 1, FIG. 2, FIG. 3 or one or more of the blocks of FIG. 4 or FIG. 5. As an example, such circuitry may be present in one or more of the system 600 of FIG. 6 or the system 700 of FIG. 7. Accordingly, information may be gathered from one or more sensors during deployment and used by a controller to control a deployment process (e.g., including opening/closing valves, relieving pressure, sensing, delivering chemical, etc.).

Figure 9:
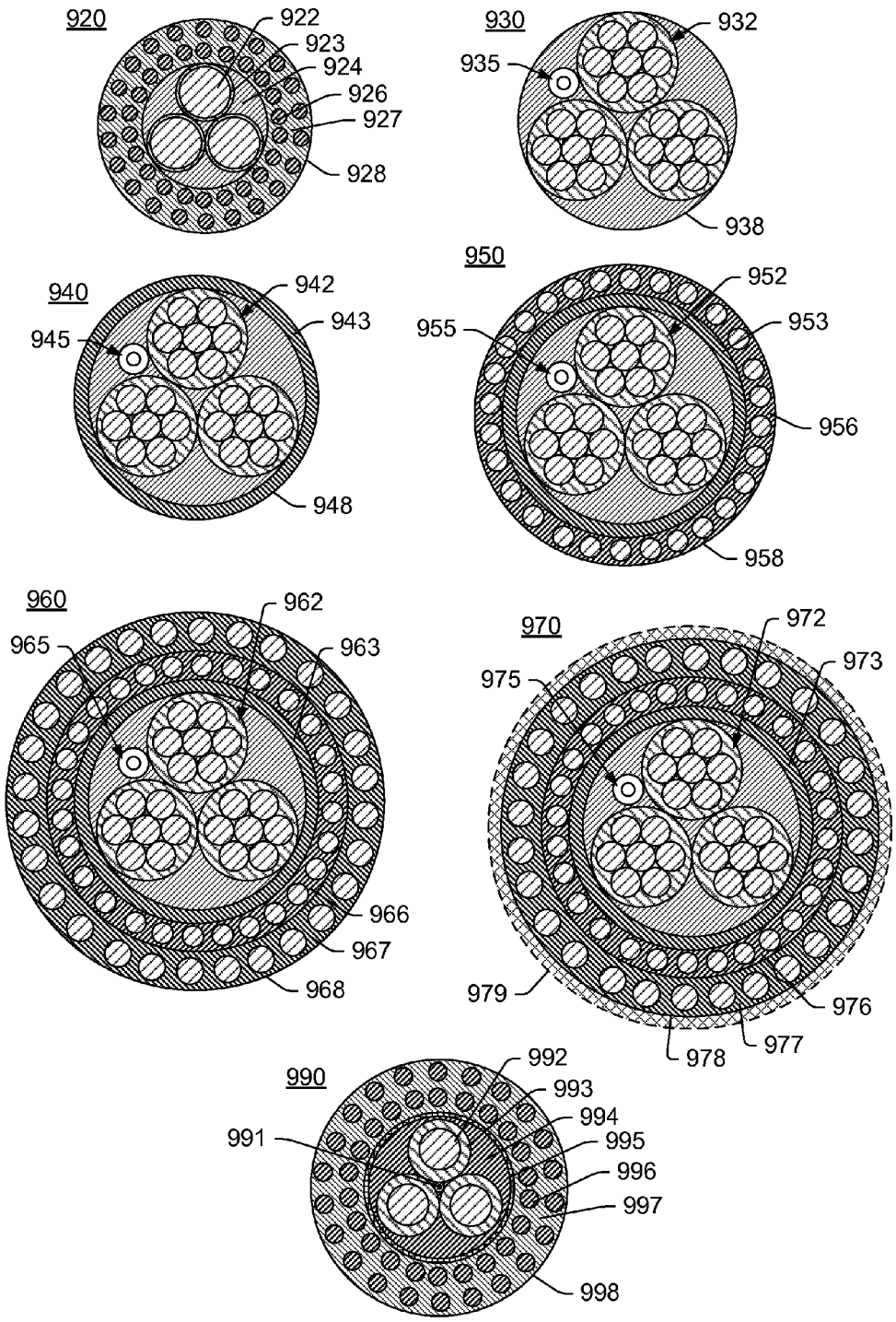
FIG. 9 illustrates examples of cables.

FIG. 9 shows various cross-sections of examples of cables 920, 930, 940, 950, 960, 970 and 990. As shown, the cable 920 includes three conductive cores 922 where each conductive core 922 includes an insulator layer 923, which are disposed in a matrix 924, which is surrounded by another matrix 927 that includes strength members 926. The matrix 927 includes an outer surface 928. As an example, a cable may include solid-stranded metallic conductors, metallic strength members in a continuously bonded polymeric jacketing system and a smooth, easily sealable outer polymer jacket.

The cables 930, 940, 950, 960 and 970 may be different types of cables or may represent progressive stages for forming one or more cables. For example, given the cable 930, the cables 940, 950 and 960 may represent progressive stages for forming the cable 970.

The cable 930 includes stranded conductors in insulator 932 and an optical fiber or other fiber 935, which are encased within an outer surface 938. The cable 940 includes stranded conductors in insulator 942 and an optical fiber or other fiber 945, which are encased within a layer of material 943 within an outer surface 948. The cable 950 includes stranded conductors in insulator 952 and an optical fiber or other fiber 955, which are encased within a layer of material 953 surrounded by a strength member layer 956 within an outer surface 958. The cable 960 includes stranded conductors in insulator 962 and an optical fiber or other fiber 965, which are encased within a layer of material 963 surrounded by a first strength member layer 966 surrounded by a second strength member layer 967 within an outer surface 968. The cable 970 includes stranded conductors in insulator 972 and an optical fiber or other fiber 975, which are encased within a layer of material 973 surrounded by a first strength member layer 976 surrounded by a second strength member layer 977 within an outer surface 978 surrounded by armor 979.

The cable 990 includes an optical fiber or other fiber 991 and three conductive cores 992 where each conductive core 992 includes an insulator layer 993, which are disposed in a matrix 994, which is surrounded by a tie layer 995 surrounded another matrix 997 that includes strength members 996. The matrix 997 includes an outer surface 998. As an example, a cable may include solid-stranded metallic conductors, metallic strength members in a continuously bonded polymeric jacketing system and a smooth, easily sealable outer polymer jacket.

As an example, a cable core may be constructed with one or more conductors that form a power carrier. The conductors may be constructed from a variety of conductive materials in a variety of forms, e.g. copper conductors each formed of a solid copper element or of copper strands. As an example, a cable core may include three conductors to enable delivery of three-phase power (e.g., multiphase power) to a motor of an electric submersible pumping system. As an example, three copper conductors may be cabled together in a triad configuration. Additionally, each conductor may be covered by a layer of electrical insulation material, which may be formed from polymeric material.

As to an optical fiber, it may provide for transmission of information, sensing, etc. and may be enclosed in a protective layer or tube (e.g., depending on particular use thereof). As an example, a cable may include one or more data carriers, such as one or more optical fibers. In such an example, an optical fiber may be used to provide telemetry of depth-referenced data such as temperature, strain, and other parameters. As an example, a data carrier may be protected by one or more features of a cable. As an example, a cable may have sufficient strength to provide support during conveyance and use, to provide power and/or data transmission with respect to an electric submersible pumping system, and to withstand the conditions of long-term exposure in the downhole environment.

As an example, an optical fiber may be configured as a sensor to measure strain, temperature, pressure and another quantity, for example, where a quantity to be measured modulates one or more of intensity, phase, polarization, wavelength or transit time of light in the fiber. As an example, an optical fiber may sense strain in a cable (e.g., be configured to measure strain in a cable). As an example, a controller may be configured to control one or more pieces of equipment responsive to sensed strain. As an example, a process that involves moving a pump via a power cable operatively coupled to the pump may include sensing strain via an optical fiber disposed in the power cable. As an example, such information may be used in conjunction with load information and/or other information, for example, to help reduce risk of damage to a power cable and/or equipment operatively coupled thereto. For example, where strain exceeds a certain level, a controller may respond by adjusting one or more valves, reels, etc.

As an example, strength members may be cabled over a layer at a desired lay angle. Depending on the environment in which a cable is to be employed, strength members may be formed from a variety of materials, for example, to provide sufficient integrity to assist in supporting weight of both a cable and a downhole assembly during conveyance (e.g., downhole, retrieval, etc.).

As an example, multiple layers of strength members may be arranged contrahelically. As an example, materials of layers may be chemically bonded to one another. As an example, a material may be selected to provide a smooth outer surface, for example, to facilitate sealing against a cable.

As an example, a cable may include a cable core having one or more metallic conductors with one or more polymer materials layers bonded to the metallic conductors. As an example, one or more strength member layers may be bonded to the cable core, in which the strength member layers may include one or more polymer-bonded strength members. As such, the cable may be continuously bonded from the innermost metallic conductors of the cable to the outermost strength member layer of the cable. As an example, metallic conductors may be stranded and compacted conductors.

As an example, polymer layers of a cable may be bonded, for example, via a heating of metallic conductors and/or by passing the cable through an extruder. As an example, a jacketing polymer layer may be included as extruded over and/or bonded to another layer of a cable. As an example, an extruder may be used to shape an outer-profile of a cable (e.g., as the cable passes through the extruder).

As an example, polymers may be co-extruded, which may utilize melting and delivering a desired amount of one or more polymer materials through an extrusion die or head to form a desired shape and/or size.

As shown, a cable can include at least one signal carrier along which signals may be carried. As an example, a signal carrier may include a data carrier, such as one or more optical fibers or other data carriers routed along a cable. The design of a cable may provide a flexible member while also providing sufficient strength to serve as the sole support member in conveying a pump (e.g., an ESP).

As an example, a cable may be formed of a plurality of layers of wire strength members which may be isolated by a plurality of separation layers, such as polymer layers. The wire strength members may have interstices. The layers of wire strength members can surround a signal carrier which may include power and/or data carriers. Additionally, the polymer layers may include one or more types of polymer materials able to provide protection and/or insulation.

A cable may, for example, employ plural, different types of non-metallic layers and, for example, polymer materials/layers although other non-metallic materials may be employed in some applications. For example, a polymer may include an electrical insulation which is used, for example, to insulate conductors (e.g., large copper electrical power conductors) in a core of a cable. Such a polymer also may be formed from various combinations of polymer materials. As an example, polymeric materials of a cable may include polyolefins (such as EPC, modified EPC or polypropylene), ethylene propylene diene monomer (EPDM), ethylene-propylene octane, ethylene propylene block copolymer, polyaryletherether ketone, polyaryl ether ketone, polyphenylene sulfide, polymers of ethylene-tetrafluoroethylene, polymers of poly(1,4-phenylene), polytetrafluoroethylene, perfluoroalkoxy polymers, fluorinated ethylene propylene, perfluoromethoxy polymers, Parmax™, and mixtures thereof.

As an example, a cable may include a polymer as interstitial filler. Interstitial filler may be positioned around, for example, conductors in a cable core which are insulated by polymer. Examples of polymer may include a soft polymer with a Shore A hardness between 10 and 100, for example, like thermoplastic fluoro elastomers, ethylene-propylene copolymers, ethylene propylene block copolymer or other soft thermoplastic elastomers or thermoplastic.

Additionally, a polymer may be employed as an outer jacket to a cable core. Such polymer may be a harder polymer able to provide protection of a cable core or other cable components. Such polymer may include one or more polymers that can be used as is or reinforced with, carbon, glass, aramid or other suitable natural or synthetic fiber and or other reinforcing additives such as micron sized PTFE, graphite, polyolefins (e.g., EPC, modified EPC or polypropylene), polyaryletherether ketone, polyaryl ether ketone, polyphenylene sulfide, polymers of ethylene-tetrafluoroethylene, polymers of poly(1,4-phenylene), polytetrafluoroethylene, perfluoroalkoxy polymers, fluorinated ethylene propylene, perfluoromethoxy polymers, Parmax™, and mixtures thereof. As an example, a polymer may be employed to protect layers of wire strength members. Examples of polymer can include a protective polymeric coating that is applied to each strand of wire for corrosion protection. As an example, one or more of the following coatings may be used: fluoropolymer coating, FEP, Tefzel™, PFA, PTFE, MFA, PEEK or PEK with fluoropolymer combination, PPS and PTFE combination, and natural or synethic rubber coating. As an example, a strand or strands of wire may be plated with a 0.5-mil to 3-mil metallic coating which may enhance bonding of the wire to a polymeric jacket material. As an example, a plating material may include: ToughMet™ (a high-strength, copper-nickel-tin alloy manufactured by Brush Wellman), brass, copper, copper alloy, nickel and its alloys, and any other suitable metals or combination of the same. Specific arrangement of polymer layers and polymer material types may be changed or substituted according to conditions for a given application and environment. One or more polymers may be used to create, in part, a desired cable for a specific application and environment. As an example, a polymer layer may be chemically bonded to another polymer layer (e.g., through the interstices of a layer).

As an example, a method can include providing a pump connected to a power cable that includes a smooth polymeric surface; providing a stuffing box that includes a valve configured to form a seal with the smooth polymeric surface of the power cable in a closed state and to form a passage for the pump as connected to the power cable in an open state; providing a lubricator that includes a passage to accommodate the pump as connected to the power cable; providing a blow-out protector that includes a valve configured to form a seal with the smooth polymeric surface of the power cable in a closed state and to form a passage for the pump as connected to the power cable in an open state; and controlling the states of the valves while lowering the pump via the power cable through the stuffing box, the lubricator, and the blow-out protector to position the pump into a bore of a well.

As an example, a method may include deploying a pump via a cable where the pump includes a sensor (e.g., a gauge) and sensing information using the sensor. As an example, such a method may include sensing information using the sensor while lowering the pump via the cable. As an example, a sensor may be fitted to a distal end of the pump and may optionally include wireless transmission circuitry, for example, to transmit information wirelessly during deployment (e.g., within a specified range, which may be proximate to a wellhead).

As an example, a method may include controlling states of valves based at least in part on sensed information. In such an example, a valve may be a stuffing box valve, a blow-out protector valve, a production string valve, etc.

As an example, a method may include controlling states of valves while lowering a pump where such controlling includes one or more of maintaining an open state, maintaining a closed, transitioning from a closed state to an open state and transitioning from an open state to a closed state.

As an example, a method may include lowering a pump by moving the pump, halting the pump and moving the pump. For example, lowering may include halting, which may be temporary (e.g., optionally during a process such as transitioning a state of a valve, relieving pressure from a live well, sensing information, etc.). As an example, a method may include terminating lowering of a pump upon contacting the pump with a structure in a bore of a well (e.g., a wellbore). For example, such a structure may be a seat configured to seat the pump (e.g., an ESP, etc.).

As an example, a method may include deploying a pump via a power cable in a live well where the live well includes a well pressure in excess of an ambient pressure, which may be a surface pressure. As an example, such a method may include isolating a portion of the power cable between a blow-out protector and a stuffing box (e.g., where the blow-out protector is located below the stuffing box). As an example, where a blow-out protector valve is in an open state, a stuffing box valve may be in a closed state to provide a pressure barrier. For example, the stuffing box valve may form a seal about a power cable where the seal is sufficient to prevent flow of fluid from a live well through the stuffing box valve (e.g., via a valve-cable interface).

As an example, a controller can include a processor; memory accessible by the processor; and control logic implemented by the processor to control a deployment process for deploying a pump connected to a cable into a bore by controlling states of valves associated with the bore. In such an example, the valves may include a stuffing box valve and a blow-out protector valve. As an example, more than one stuffing box valve may be controlled. As an example, more than one blow-out protector valve may be controlled. As an example, a stuffing box may be located above a blow-out protector.

As an example, a controller may be configured to control production string valves of a production string disposed in a bore, which may be a bore of a live well (e.g., a well that includes a pressure in excess of an ambient pressure). In such an example, the production string may include two lengths of production string that extend into the bore below a blow-out protector where each of the lengths is fitted with a respective one of the production string valves. As an example, production string valves may include a hydraulically operated valve, an electrically operated valve or a hydraulically operated valve and an electrically operated valve. As an example, a controller may be configured to control one or more hydraulically operated valves, one or more electrically operated valves or at least one hydraulically operated valve and at least one electrically operated valve.

As an example, a controller may include control logic that is configured to control a deployment process based at least in part on receipt of sensed information. As an example, a controller may include control logic that is configured to maintain a valve in a closed state, maintain a valve in an open state, transition a valve from a closed state to an open state, transition a valve from an open state to a closed state, and to call for deployment of the cable from a cable reel. As an example, a controller may include control logic that can control a deployment process based at least in part on load information, for example, as provided by a load gauge (e.g., a load sensor). For example, equipment configured for deployment of a pump via power cable may include a load gauge that can output signals to a controller. Such a controller may respond to such signals by calling for one or more actions, which may include deployment of cable, retraction of cable, maintaining a state of a valve, transitioning a state of a valve, etc.

As an example, a completion can include a pump seated in a pump seat within a bore; valve units positioned in the bore above the pump; and a Christmas tree positioned at an end of the bore above the valve units, where each of the valve units forms a respective seal with a cable connected to the pump. In such an example, the bore may be a bore of a live well and the cable may be a power cable configured for delivery of power to an electric motor of the pump (e.g., an ESP). As an example, a Christmas tree may include equipment, which may be positioned at a surface location where such equipment may be in fluid communication with a bore (e.g., a wellbore). As an example, a Christmas tree may include one or more valves, one or more sensors, etc.

As an example, a completion may include production string valve units. As an example, such valve units may include signal interfaces for receipt of control signals for maintaining states and for transitioning states. For example, a system may include a controller that can control production string valves, for example, as to a process that may provide for moving a pump in a bore via a power cable operatively coupled to the pump (e.g., deploying, retracting, positioning, re-positioning, etc.). As an example such a system may provide for servicing the pump or equipment associated therewith (e.g., consider equipment of or associated with an ESP system).

Various methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to sensing process, an injection process, drilling process, an extraction process, etc.

Figure 10:
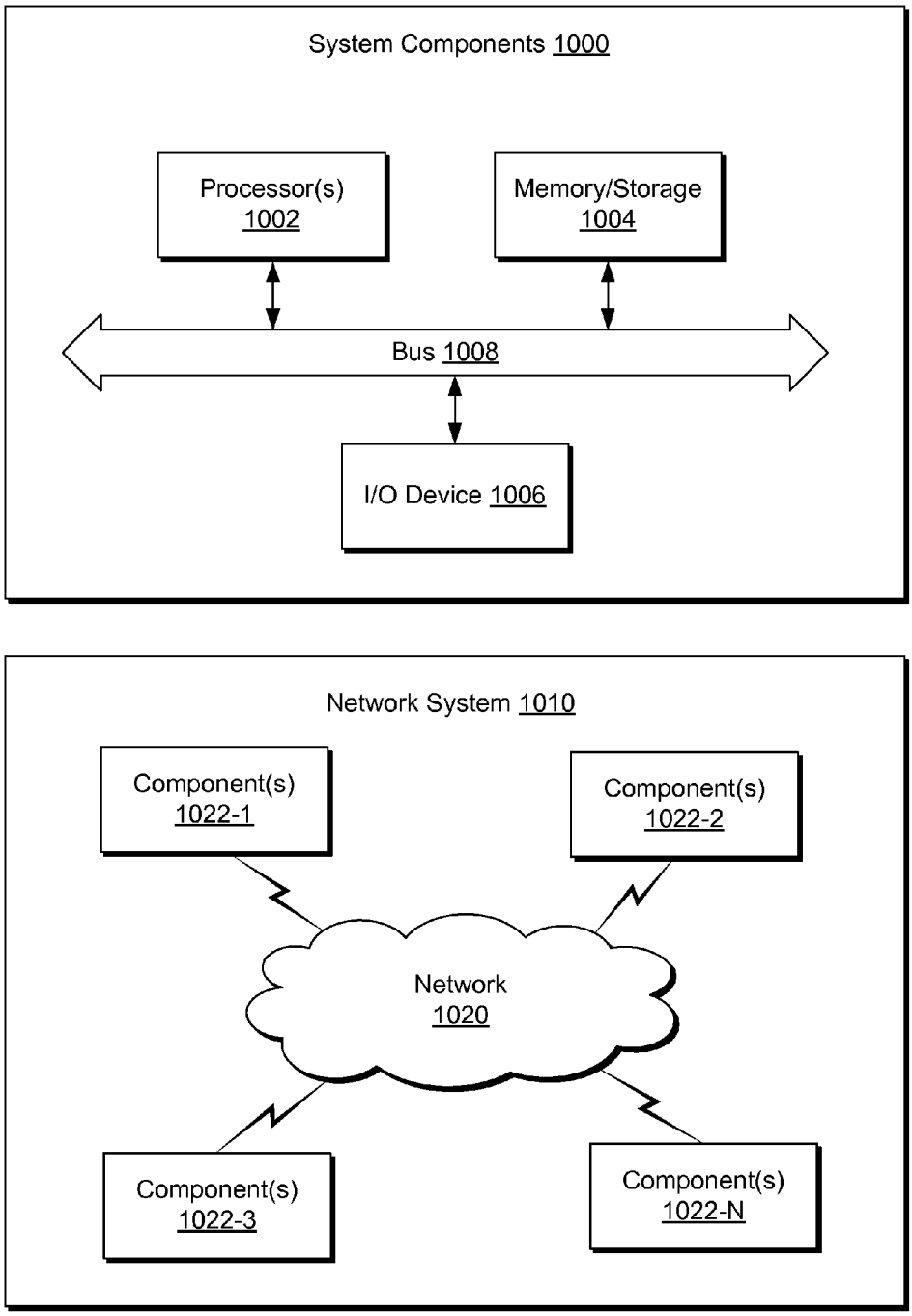
FIG. 10 illustrates example components of a system and a networked system.

FIG. 10 shows components of a computing system 1000 and a networked system 1010. The system 1000 includes one or more processors 1002, memory and/or storage components 1004, one or more input and/or output devices 1006 and a bus 1008. According to an embodiment, instructions may be stored in one or more computer-readable media (e.g., memory/storage components 1004). Such instructions may be read by one or more processors (e.g., the processor(s) 1002) via a communication bus (e.g., the bus 1008), which may be wired or wireless. The one or more processors may execute such instructions to implement (wholly or in part) one or more attributes (e.g., as part of a method). A user may view output from and interact with a process via an I/O device (e.g., the device 1006). According to an embodiment, a computer-readable medium may be a storage component such as a physical memory storage device, for example, a chip, a chip on a package, a memory card, etc.

According to an embodiment, components may be distributed, such as in the network system 1010. The network system 1010 includes components 1022-1, 1022-2, 1022-3, . . . 1022-N. For example, the components 1022-1 may include the processor(s) 1002 while the component(s) 1022-3 may include memory accessible by the processor(s) 1002. Further, the component(s) 1002-2 may include an I/O device for display and optionally interaction with a method. The network may be or include the Internet, an intranet, a cellular network, a satellite network, etc.

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words "means for" together with an associated function.

The invention claimed is:

1. A method comprising:

providing a pump connected to a power cable that comprises a smooth polymeric surface;

providing a stuffing box that comprises a valve configured to form a seal with the smooth polymeric surface of the power cable in a closed state and to form a passage for the pump as connected to the power cable in an open state;

providing a lubricator that comprises a passage to accommodate the pump as connected to the power cable;

providing a blow-out protector that comprises a valve configured to form a seal with the smooth polymeric surface of the power cable in a closed state and to form a passage for the pump as connected to the power cable in an open state;

controlling the states of the valves while lowering the pump via the power cable through the stuffing box, the lubricator, and the blow-out protector to position the pump in a bore of a well; and wherein the pump is monitored via a sensor and further comprising sensing information using the sensor.

2. The method of claim 1 comprising sensing information using the sensor while lowering the pump.

3. The method of claim 2 further comprising controlling the states of the valves based at least in part on the information.

4. The method of claim 1 wherein controlling the states of the valves while lowering the pump comprises at least one member selected from a group consisting of maintaining an open state, maintaining a closed, transitioning from a closed state to an open state and transitioning from an open state to a closed state.

5. The method of claim 1 wherein lowering the pump comprises moving the pump, halting the pump and moving the pump.

6. The method of claim 1 wherein lowering the pump terminates upon contacting the pump with a structure in the bore of the well.

7. The method of claim 1 wherein the well comprises a live well that comprises a well pressure in excess of an ambient pressure.

8. The method of claim 7 comprising isolating a portion of the power cable between the blow-out protector and the stuffing box.

9. The method of claim 7 wherein, where the blow-out protector valve is in the open state, the stuffing box valve is in the closed state to provide a pressure barrier.

* * * * *